US007415989B2

(12) United States Patent
Barber

(10) Patent No.: US 7,415,989 B2
(45) Date of Patent: Aug. 26, 2008

(54) SPOOL ACTIVATED LOCK-OUT VALVE FOR A HYDRAULIC ACTUATOR LOAD CHECK VALVE

(75) Inventor: Dennis R. Barber, Pewaukee, WI (US)

(73) Assignee: HUSCO International, Inc., Waukesha, WI (US)

( * ) Notice: Subject to any disclaimer, the term of this patent is extended or adjusted under 35 U.S.C. 154(b) by 435 days.

(21) Appl. No.: 11/317,317

(22) Filed: Dec. 23, 2005

(65) Prior Publication Data

US 2007/0144588 A1 Jun. 28, 2007

(51) Int. Cl.
*F15B 13/04* (2006.01)

(52) U.S. Cl. ..... 137/596.18; 137/596.12; 91/447

(58) Field of Classification Search ..... 137/596.12, 137/596.14, 596.17, 596.18, 106; 91/420, 91/444–448, 459, 461
See application file for complete search history.

(56) References Cited

U.S. PATENT DOCUMENTS

| | | | | | |
|---|---|---|---|---|---|
| 2,363,235 | A * | 11/1944 | Ellinwood | 137/596.12 |
| 3,125,120 | A * | 3/1964 | Hasbany | 137/596.12 |
| 3,151,455 | A * | 10/1964 | Tennis | 91/446 |
| 3,433,131 | A * | 3/1969 | Soyland et al. | 91/447 |
| 3,541,927 | A * | 11/1970 | Iijima | 91/447 |
| 3,714,868 | A * | 2/1973 | Kowalski et al. | 91/420 |
| 3,951,162 | A * | 4/1976 | Wilke | 91/447 |
| 4,958,553 | A * | 9/1990 | Ueno | 91/447 |
| 5,018,935 | A * | 5/1991 | Gage | 91/420 |
| 5,279,121 | A * | 1/1994 | Barber | 137/596.13 |
| 5,579,642 | A * | 12/1996 | Wilke et al. | 91/446 |
| 5,715,865 | A * | 2/1998 | Wilke | 91/446 |
| 5,832,808 | A * | 11/1998 | Ishizaki et al. | 91/447 |
| 5,921,279 | A * | 7/1999 | Barber | 91/464 |
| 6,327,959 | B1 * | 12/2001 | Takahashi et al. | 91/436 |
| 6,637,461 | B2 * | 10/2003 | Post | 137/625.63 |
| 6,895,852 | B2 * | 5/2005 | Pieper | 91/516 |

* cited by examiner

*Primary Examiner*—Stephen M. Hepperle
*Assistant Examiner*—Craig Price
(74) *Attorney, Agent, or Firm*—Quarles & Brady; George E. Haas

(57) ABSTRACT

A check valve system controls the flow of fluid between a spool valve and a hydraulic actuator and includes a pilot operated check valve that is controlled by a lock-out valve. The check valve has a poppet that engages and disengages a first valve seat in response to a pressure in a control chamber. The lock-out valve has an inlet connected to the control chamber, an outlet connected to an opening in the bore of the spool valve, and an second valve seat between the inlet and the outlet. A valve member that selectively engages and disengages the second valve seat and spool of the spool valve applies force to the valve member which responds by moving into engagement with the second valve seat. Thus in one position, the spool valve maintains the lock-out valve closed which traps pressure in the control chamber which tend to keep the check valve closed.

20 Claims, 1 Drawing Sheet

SPOOL ACTIVATED LOCK-OUT VALVE FOR A HYDRAULIC ACTUATOR LOAD CHECK VALVE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to hydraulic systems, and more particularly to check valves which isolate an unpowered actuator from the remainder of the hydraulic system, and specifically to lock-out valves that tend to prevent such check valves from opening under high pressure conditions from the actuator.

2. Description of the Related Art

Hydraulic systems are utilized to power numerous kinds of mechanical equipment. A hydraulic actuator, such as a cylinder-piston arrangement, typically is used to move a component of the equipment. In a backhoe for example, one hydraulic cylinder moves the bucket with respect to an arm, another hydraulic cylinder provides motion between the arm and a boom, and an additional hydraulic cylinder raises and lowers the boom with respect to the vehicle frame.

A valve assembly controls the application of pressurized hydraulic fluid from a pump to the hydraulic actuator and controls the return of fluid from the actuator to a reservoir, commonly referred to as a tank. A spool-type valve often provides this control function. In this type of valve, a valve block has a bore into which a plurality of passages open leading to the cylinder chambers, the pump, and the tank. The spool is formed with several grooves and lands so that as it slides within the bore, the grooves connect the different passages. In various positions of the spool, fluid from the pump is applied to either of the two cylinder chambers and drained to tank from the other cylinder chamber. Which cylinder chamber receives the pressurized fluid determines the direction that the hydraulic actuator moves. In a centered position, the spool blocks the fluid flow to and from the hydraulic actuator. However, in the closed position some leakage occurs from the cylinder chambers to the tank passages regardless of the tolerance between the spool and the bore. Such leakage allows the machine component being driven by the hydraulic actuator to move unintentionally, which is undesirable. For example, a raised boom assembly of a backhoe may drop slowly when the control valve assembly is held for a prolonged time in the closed position.

Therefore, a common practice was to provide a conventional pilot operated, poppet check valve between the control valve assembly and the hydraulic actuator. A poppet-type valve has relatively low leakage-type as compared to a spool valve. Pressure from operation of the spool valve was applied to a pilot chamber behind of the check valve to operate a pilot piston that engaged and disengaged the poppet of the check valve to close and open a pilot passage in the poppet. Opening the pilot passage allowed the poppet to move away from the seat of the check valve. Although the combination of the pilot operated, poppet check valve with the conventional spool valve significantly reduced the leakage problem, some leakage of the pilot pressure still occurred in the spool valve.

SUMMARY OF THE INVENTION

A hydraulic valve assembly has a valve spool that moves within a spool bore to control flow of fluid to a workport that is adapted to be connected to a hydraulic actuator. A check valve system is provided in the hydraulic valve assembly and includes a check valve that is controlled by a separate lock-out valve.

The check valve has a poppet which engages and disengages a first valve seat to control flow of fluid between the spool bore and the hydraulic actuator, and has a control chamber in which pressure controls movement of the poppet. The lock-out valve has an inlet connected to the control chamber, an outlet connected to an opening in the spool bore, and a second valve seat between the inlet and the outlet. A valve member of the lock-out valve selectively engages and disengages the second valve seat. The valve spool applies force to the valve member which responds by moving into engagement with the second valve seat.

In a preferred embodiment, the lock-out valve is located at one end of the spool bore and is engaged by an end of the spool thereby consolidating functionality of the main spool valve and the lock-out valve. The valve member comprises a valve element that selectively engages and disengages the second valve seat, a shaft contacting the valve element, and a retainer coupled to an end the shaft, wherein the valve spool applies force to the retainer. A first spring biases the shaft away from the valve element and a second spring biases the retainer with respect to the shaft and toward the end.

DETAILED DESCRIPTION OF THE INVENTION

Figure 1:
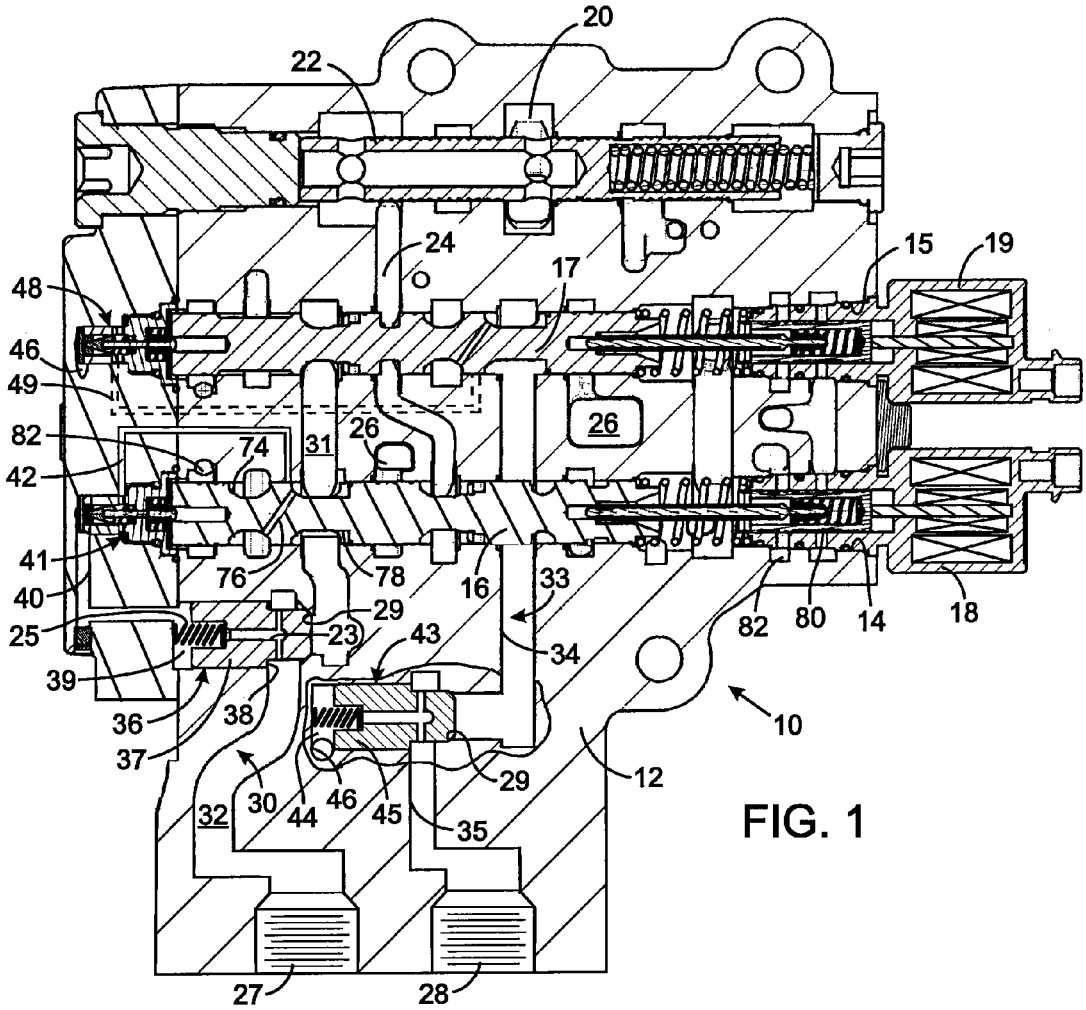
FIG. 1 is a cross-sectional view through a spool valve assembly that incorporates the present invention.

With initial reference to FIG. 1, a valve assembly 10 for a hydraulic system includes a valve body 12 with a pair of primary valves formed by spool bores 14 and 15 in which first and second valve spools 16 and 17 are respectively received. One end of each valve spool 16 or 17, which form a control element, is connected to a unidirectional, linear actuator 18 or 19, such as a proportional solenoid, that is secured in one end of the associated spool bore 14 or 15. The linear actuators 18 and 19 slide the respective valve spool 16 or 17 in the spool bore from the illustrated closed position to the right in the orientation of the valve assembly in FIG. 1. The amount that the valve spool moves opens the valve to varying degrees thereby proportionally controlling the flow of fluid through the valve. It should be understood that the novel check valve assembly of the present invention can be used with other kinds of primary valves that just those of the spool type.

The valve body 12 has a pump inlet passage 20 that is connected by a conventional pressure compensation valve 22 to a bridge passage 24 which intersects both spool bores 14 and 15. A pair of tank passages 26 also communicate with the spool bores. The valve body 12 has a pair of workports 27 and 28 for connection to the hydraulic actuator being controlled. Specifically, the first workport 27 is connected to both spool bores 14 and 15 by a first workport passage 30 that is divided into two sections 31 and 32 with a first valve seat 29 there between. The second workport 28 is similarly connected to both spool bores by a second workport passage 33 that is divided into two sections 34 and 35 with another first valve seat 29 there between.

A pilot-operated first check valve 36 is located between the different sections 31 and 32 of the first workport passage 30 and is oriented so that pressure within section 31 from the spool bore, acting on the nose of the check valve poppet 37, tends to unseat the poppet. The poppet 37 has an annular surface 38 on which the pressure from the first workport 27 acts also tending to unseat the poppet. A check valve spring 25 biases the poppet 37 toward the first valve seat against the force from those pressures. The first check valve 36 has a first control chamber 39 on a side of the poppet 37 that is remote from the first valve seat 29 and a channel 23 through the poppet connects section 32 of the first workport passage 30 to the control chamber. A first control passage 40 connects the first control chamber 39 to a first lock-out valve 41 that is located at the opposite end of the first spool bore 14 from the first linear actuator 18. The first lock-out valve 41 selectively connects the first control passage 40 to a first lock-out passage 42 which opens into the first spool bore 14 adjacent the intersection with the first section 31 of the first workport passage 30. Movement of the spool couples the first lock-out passage 42 to the first workport passage section 31. Alternatively, the first lock-out passage 42 can open directly into the first section 31 of the first workport passage 30. As will be described, operation of the first lock-out valve 41 controls the pressure in the first control chamber 39 and thus movement of the poppet 37 in the first check valve 36.

An identical second check valve 43 with a poppet 45 is located between the two sections 34 and 35 of the second workport passage 33. The second check valve 43 has a second control chamber 44 that is connected by a second control passage 46 to a second lock-out valve 48 which is located at the remote end of the second spool bore 15 from the second linear actuator 19. Note that the second control passage 46 extends between the second control chamber 44 and the second lock-out valve 48 in a parallel plane to that of the cross-sectional drawing of FIG. 1. The second lock-out valve 48 controls communication between the second control passage 46 and a second lock-out passage 49 which opens at a point in the second spool bore 15 adjacent the intersection with the second workport passage 33. Alternatively, the second lock-out passage 49 can open directly into the second workport passage 33.

Figure 2:
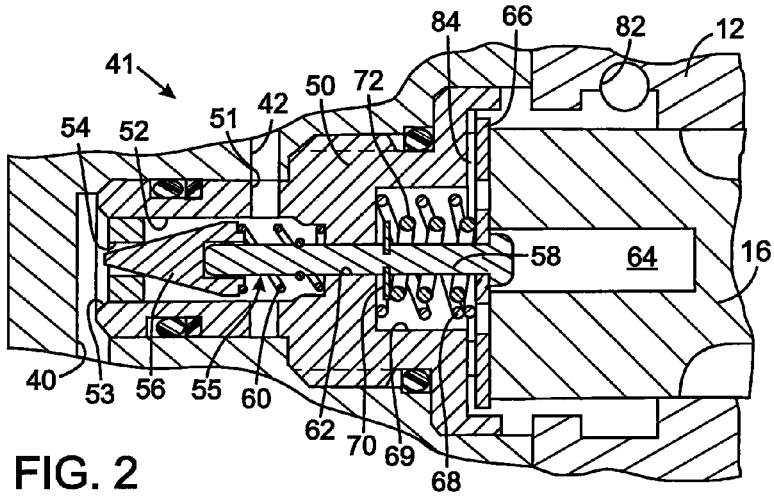
FIG. 2 is an enlarged view of the section of FIG. 1 showing details of a lock-out valve.

FIG. 2 illustrates the details of the first lock-out valve 41, with the understanding that the second lock-out valve 48 has an identical construction. The first lock-out valve 41 comprises a cartridge 50 that is threaded into the remote end of the first spool bore 14 and has a nose which extends into the first control passage 40. The cartridge 50 has an internal chamber 52 that is separated from the first control passage 40 by a second valve seat 54 and which communicates with the first lock-out passage 42 through an outlet 51. A valve member 55 includes a valve element 56, such as a conical dart, slidably located at one end of a shaft 58 within the internal chamber 52, for engaging the second valve seat 54 to control the flow of fluid between an inlet 53 and the outlet 51 of the first lock-out valve 41. A dart spring 60 biases the valve element 56 with respect to the cartridge 50 and toward engagement with the second valve seat 54.

The shaft 58 of the first lock-out valve 41 extends through an aperture 62 in the valve cartridge 50 and into a cavity 64 at the adjacent end of the first valve spool 16. The end of the shaft 58 within the cavity 64 has a head that engages a disk-shaped retainer 66 through which the shaft extends. In the illustrated closed state of the valve spool 16, the retainer 66 abuts the facing end of the cartridge 50 and a first spring 68 in a cartridge recess 69 biases the retainer 66 away from that end of the cartridge 50. A C-clip 70 is received within a circumferential groove on the shaft 58 and a second spring 72 engages the clip to bias the retainer 66 against the head of the shaft. The second spring 72 absorbs force as the valve spool 16 drives the valve element 56 against the second valve seat 54, thereby preventing damage to the sealing surface of the valve element and that valve seat.

In this manner, the first valve spool 16 applies non-hydraulic force to the lock-out valve member 55 which responds by moving into engagement with the second valve seat 54.

In the closed position shown in FIG. 1, the first valve spool 16 applies non-hydraulic force to the lock-out valve member 55 which responds by moving into engagement with the second valve seat 54. Specifically, the end of the valve spool 16 that is remote from the linear actuator 18 abuts the retainer 66 of the first lock-out valve 41, as illustrated in detail in FIG. 2. This forces the retainer 66 against the cartridge 50. Now, the second spring 72 acts on the C-clip 70 to push the shaft 58 and the valve element 56 against the second valve seat 54, closing communication between the first control passage 40 and the first lock-out passage 42. This traps the pressure within the first control chamber 39 of the first check valve 36 in FIG. 1. Note that a small passage exists through the poppet of the first check valve 36 from the workport end of the first workport passage 30, thereby applying the workport pressure to the control chamber 39. Therefore, the workport pressure acting on the relatively small annular surface 38 cannot open the first check valve 36.

When the machine operator commands motion of the hydraulic actuator controlled by the valve assembly 10, a signal is sent to one of the two linear actuators 18 or 19, depending upon the direction of the desired motion. If the hydraulic actuator is a cylinder-piston assembly, activation of one linear actuator causes the piston rod to retract into the cylinder, whereas the other linear actuator causes the piston rod to extend farther from the cylinder. When the first linear actuator 18 is activated, the output shaft moves a valve component 80 which action applies pressure through a passage 82 that leads to a chamber 84 at the opposite end of the first valve spool 16. Application of that pressure to that opposite end drives the first valve spool 16 to the right in the drawings, into a position in which the bridge passage 24 is connected to the second workport passage 33 and in which the first workport passage 30 is connected to the tank passage 26. Application of pressurized fluid to section 34 of the second workport passage 33 applies a significant pressure to the relatively large surface of the nose of the second check valve 43, causing that check valve to unseat and convey fluid to the second workport 28.

Referring both FIGS. 1 and 2, the motion of the first valve spool 16 to the right and away from the first lock-out valve 41, releases the force that the valve spool previously applied to the retainer 66. This enables the opposing force from the first spring 68 to push the retainer toward the receding valve spool 16 and away from the cartridge 50. This motion carries the shaft 58 with the retainer 66, thereby releasing the mechanical force that previously held the valve element 56 against the second valve seat 54. At this time, a first groove 74 in the first valve spool 16 is aligned with the opening of the first lock-out passage 42 into the first spool bore 14. A fluid path now exists from that first groove 74 through a cross spool passage 76 to an adjacent second groove 78 which is now aligned with the tank passage 26. Thus the first control passage 40 is connected to the tank passage 26.

Since at this time pressure in the first control passage 40 is greater than the tank pressure in the first lock-out passage 42, the lock-out valve element 56 moves away from the second valve seat 54. This opens a fluid path, through the lock-out valve 41, between the first control passage 40 and the first lock-out passage 42. That path combined with the previously described path through valve spool 16 to the tank passage 26 releases the pressure within the first control chamber 39 of the first check valve 36.

With the pressure in the first control chamber 39 relieved, the pressure from first workport 27 applied to the annular surface 38 causes the poppet 37 in the first check valve 36 to unseat. This opens a path between the two sections 31 and 32 of the first workport passage 30, thereby allowing fluid from the first workport 27 to flow through the second spool groove 78 to the tank passage 26. It should be noted that until the pressure in the first control chamber 39 is released in this manner, pressure from the first workport 27, acting on the relatively small annular surface 38, was insufficient to unseat the first check valve 36.

Assume now that both valve spools 16 and 17 are closed thereby blocking communication between the workports 27 and 28 and the supply and tank passages, as depicted in FIG. 1. As the fluid between valve assembly 10 and the hydraulic actuator now increases in temperature, the fluid expands which increases the pressure at the associated workport. It is desirable to relieve that pressure to prevent a component failure, such as a burst hose. In the present valve assembly 10, pressure at the first workport 27 is conveyed through the internal channel 23 in the first check valve 36 and the first control passage 40 to the nose of the first lock-out valve 41. This increased pressure due to thermal expansion operates on the tip of the valve element 56 in FIG. 2, thereby exerting a force that tends to unseat the valve element. That force is applied through the shaft 58 to the C-clip 70 and against the force of the second spring 72. The force of the second spring 72, holds the valve element 56 against the second valve seat 54 until the highest pressure that normally occurs at the first workport 27 (e.g. 200 bar) is exceeded by a predefined pressure margin (e.g. 30 bar). When the pressure in the first control passage 40 exceeds that combined pressure level (e.g. 230 bar), the force of the second spring 72 is overcome. This causes the valve element 56 to move away from the second valve seat 54 opening a path that relieves the excessive pressure to the first spool bore 14 via the first lock-out passage 42. Although the first valve spool 16 is in the closed state, sufficient fluid leakage occurs to release the excessive thermally induced pressure. When the pressure at the first workport 27 decreases below the highest normal pressure plus the predefined pressure margin, the force of the second spring 72 again closes the first lock-out valve 41.

Float of a hydraulic actuator can be commanded by fully activating both the associated first and second valve spools 16 and 17. In the float state, both the first and second check valves 36 and 43 are vented by the respective first and second lock-out valve 41 and 48. The combination of the valve element 56 and the dart spring 60 in the lock-out valve 41 or 48 vents the associated check valve poppet 37 or 45. At this time, it is desirable to allow fluid flow from tank to the workport to prevent cavitation. The first and second check valve 36 or 43 block tank pressure from chambers 39 and 44, so that a negative pressure in the workport can be sensed so as to cause the respective check valve 36 or 43 to open.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A check valve system for a hydraulic valve assembly which has a primary valve with a control element that moves to control flow of fluid to a hydraulic actuator, said check valve system comprising:

a check valve having a poppet that engages and disengages a first valve seat to control flow of fluid between the primary valve and the hydraulic actuator, and having a control chamber with pressure therein controlling movement of the poppet; and a lock-out valve having an inlet in fluid communication with the control chamber and an outlet with an second valve seat between the inlet and the outlet, the lock-out valve comprising a valve member that selectively engages and disengages the second valve seat, wherein the control element applies non-hydraulic force to the valve member which responds by moving into engagement with the second valve seat.

2. The check valve system as recited in claim 1 wherein the control element is a valve spool that moves within a spool bore; and the lock-out valve is located in the spool bore at one end of the valve spool.

3. The check valve system as recited in claim 2 wherein the outlet of the lock-out valve is connected to an opening in the spool bore.

4. The check valve system as recited in claim 1 wherein the lock-out valve further comprises a spring biasing the valve member away from the second valve seat.

5. The check valve system as recited in claim 1 wherein the valve member comprises a valve element that selectively engages and disengages the second valve seat, a shaft contacting the valve element, and a retainer coupled to the shaft, wherein the control element applies force to the retainer.

6. The check valve system as recited in claim 1 wherein the valve member comprises a valve element that selectively engages and disengages the second valve seat, a shaft having a first end engaging the valve element and having a second end, and a retainer mounted on the shaft adjacent the second end, wherein the control element applies force to the retainer.

7. The check valve system as recited in claim 6 wherein the lock-out valve further comprises:

a first spring biasing the valve member away from the second valve seat; and a second spring biasing the retainer along the shaft toward the second end.

8. The check valve system as recited in claim 7 wherein the lock-out valve further comprises a third spring biasing the valve element toward the second valve seat.

9. The check valve system as recited in claim 1 wherein the poppet of the check valve defines a fluid channel between the control chamber and a workport that is provided in the hydraulic valve assembly for connection to the hydraulic actuator.

10. The check valve system as recited in claim 1 wherein the poppet of the check valve is biased toward the first valve seat by a check valve spring.

11. A check valve system for a hydraulic valve assembly which has a valve spool that slides within a spool bore to control flow of fluid through a passage to a workport, said check valve system comprising:

a check valve within the passage and having a poppet that engages and disengages a first valve seat to control flow of fluid between the spool bore and the workport, and having a control chamber a side of the poppet that is remote from the first valve seat; and a lock-out valve having an inlet connected to the control chamber and an outlet connected to an opening in the spool bore with an second valve seat between the inlet and the outlet, the lock-out valve comprising:

(a) a valve element that selectively engages and disengages the second valve seat, (b) a shaft having a first end section in contact with the valve element and having a second end, (c) a retainer coupled to the shaft, wherein the valve spool applies force to the retainer that tends to move the valve element into engagement with the second valve seat, (d) a first spring biasing the shaft away from the valve element; and (e) a second spring biasing the retainer with respect to the shaft and toward the second end.

12. The check valve system as recited in claim 11 wherein the lock-out valve is located in the spool bore at one end of the valve spool.

13. The check valve system as recited in claim 11 wherein the lock-out valve further comprises a third spring biasing the valve element toward the second valve seat.

14. The check valve system as recited in claim 11 wherein the poppet of the check valve defines a fluid channel between the control chamber and the passage to the workport.

15. The check valve system as recited in claim 11 wherein the poppet of the check valve is biased toward the first valve seat by a check valve spring.

16. In a hydraulic valve assembly which has a valve spool that slides within a spool bore to control flow of fluid to a workport, a check valve system comprising:

a check valve located in a passage between the spool bore and the workport and having a poppet that engages and disengages a first valve seat to control flow of fluid in the passage, and having a control chamber on a remote side of the poppet from the first valve seat; and a lock-out valve comprising:

(a) a cartridge with an inlet in fluid communication with the control chamber and an outlet connected to an opening in the spool bore, and having an second valve seat between the inlet and the outlet, (b) a valve element moveable within the cartridge to selectively engage and disengage the second valve seat, (c) a shaft having a first end and a second end, wherein the first end engages the valve element, (d) a retainer mounted on the shaft, wherein the valve spool engages the retainer to apply force that tends to move the valve element into engagement with the second valve seat, (e) a first spring engaging the cartridge and biasing the retainer away from the cartridge to enable the valve element to disengage from the second valve seat; and (f) a second spring biasing the shaft with respect to the retainer and toward the second valve seat.

17. The check valve system as recited in claim 16 wherein the cartridge of the lock-out valve is located in the spool bore at one end of the valve spool.

18. The check valve system as recited in claim 16 wherein the lock-out valve further comprises a third spring biasing the valve element toward the second valve seat.

19. The check valve system as recited in claim 16 wherein the poppet of the check valve includes a fluid channel therein which provides fluid communication between the control chamber and the workport.

20. The check valve system as recited in claim 16 wherein the poppet of the check valve is biased toward the first valve seat by a check valve spring.

* * * * *